US010588379B2

(12) United States Patent
Sussmann

(10) Patent No.: US 10,588,379 B2
(45) Date of Patent: Mar. 17, 2020

(54) SHOE, IN PARTICULAR A SPORTS SHOE

(71) Applicant: PUMA SE, Herzogenaurach (DE)

(72) Inventor: Reinhold Sussmann, Scheinfeld (DE)

(73) Assignee: PUMA SE, Herzogenaurach (DE)

( * ) Notice: Subject to any disclaimer, the term of this patent is extended or adjusted under 35 U.S.C. 154(b) by 178 days.

(21) Appl. No.: 15/735,112

(22) PCT Filed: Sep. 22, 2015

(86) PCT No.: PCT/EP2015/001875
§ 371 (c)(1),
(2) Date: Dec. 8, 2017

(87) PCT Pub. No.: WO2017/050342
PCT Pub. Date: Mar. 30, 2017

(65) Prior Publication Data
US 2019/0335853 A1 Nov. 7, 2019

(51) Int. Cl.
*A43B 13/18* (2006.01)
*A43B 13/12* (2006.01)
(Continued)

(52) U.S. Cl.
CPC ..... *A43B 13/181* (2013.01); *A43B 3/0047* (2013.01); *A43B 13/023* (2013.01); *A43B 13/04* (2013.01); *A43B 13/127* (2013.01)

(58) Field of Classification Search
CPC ..... A43B 13/181; A43B 13/023; A43B 13/04; A43B 13/127; A43B 13/12; A43B 13/125;
(Continued)

(56) References Cited

U.S. PATENT DOCUMENTS 429,429 A * 6/1890 Eckhardt ..... A43C 15/161 36/3 B
2,721,400 A * 10/1955 Israel ..... A43B 13/182 36/169
(Continued)

FOREIGN PATENT DOCUMENTS

CN 1291263 A 4/2001
CN 101242941 A 8/2008
(Continued)

*Primary Examiner* — Jameson D Collier
(74) *Attorney, Agent, or Firm* — Lucas & Mercanti, LLP; Klaus P. Stoffel

(57) ABSTRACT

A shoe having a sole connected with a shoe upper part. The sole includes: a first sole part having a ground plate, wherein a plurality of first damping elements which extend in a direction of loading are integrally shaped at the ground plate, a second sole part having a cover plate, wherein a plurality of second damping elements which extend in the direction of loading are integrally shaped at the cover plate, a connection part which includes a plurality of interconnected plugin connections. Each plug-in connection has a first plug connector extending downwards in the direction of loading and a second plug connector extending upwards in the direction of loading. The first plug connection frictionally engages into the hollow-cylindrical section of the first damping element and wherein the second plug connection frictionally engages into the hollow-cylindrical section of the second damping element.

14 Claims, 3 Drawing Sheets

(51) Int. Cl.
*A43B 13/14* (2006.01)
*A43B 13/02* (2006.01)
*A43B 13/04* (2006.01)
*A43B 3/00* (2006.01)

(58) Field of Classification Search
CPC ..... A43B 13/122; A43B 13/18; A43B 13/186; A43B 13/203; A43B 13/206; A43B 3/0047; A43B 3/0052; A43B 13/14
USPC ..... 36/25 R, 28, 30 R, 32 R, 31, 37, 35 R
See application file for complete search history.

(56) References Cited

U.S. PATENT DOCUMENTS 3,757,774 A * 9/1973 Hatuno ..... A43B 3/128 601/28
4,535,553 A 8/1985 Derderian
4,616,431 A * 10/1986 Dassler ..... A43B 13/181 36/28
5,233,767 A * 8/1993 Kramer ..... A43B 7/081 36/28
5,367,791 A * 11/1994 Gross ..... A43B 13/181 36/25 R
5,537,762 A * 7/1996 Walters ..... A43B 13/203 36/28
5,655,314 A * 8/1997 Petracci ..... A43B 7/081 36/3 B
6,029,962 A 2/2000 Shorten
6,625,848 B1 9/2003 Schneider
7,153,560 B2 12/2006 Hofmann
7,748,141 B2 * 7/2010 Smith ..... A43B 13/16 36/28
7,841,105 B2 11/2010 Wyszynski
9,380,830 B1 * 7/2016 Greenberg ..... A43B 13/181
10,258,110 B2 * 4/2019 Sussmann ..... A43B 13/181
2007/0033830 A1 * 2/2007 Chang ..... A43B 3/0052 36/28
2008/0005928 A1 1/2008 Koszegi
2008/0127514 A1 * 6/2008 Sussmann ..... A43B 1/0009 36/88
2008/0263894 A1 * 10/2008 Nakano ..... A43B 13/181 36/28
2008/0313928 A1 * 12/2008 Adams ..... A43B 5/1633 36/103
2012/0240432 A1 * 9/2012 Lambertz ..... A43B 7/146 36/25 R
2015/0157091 A1 * 6/2015 Hsu ..... A43B 13/40 36/44
2015/0196087 A1 * 7/2015 Meschter ..... A43B 13/18 36/25 R

FOREIGN PATENT DOCUMENTS

DE 202005012062 U1 12/2006
WO 9012518 A1 11/1990
WO 0170062 A2 9/2001
WO 03092423 A1 11/2003
WO 2006005973 A1 1/2006

* cited by examiner

SHOE, IN PARTICULAR A SPORTS SHOE

The present application is a 371 of International application PCT/EP2015/001875, filed Sep. 22, 2015, the priority of this application is hereby claimed and this application is incorporated herein by reference.

BACKGROUND OF THE INVENTION

The invention relates to a shoe, especially to a sports shoe, which comprises a sole which is connected with a shoe upper part.

Shoes of the generic kind are well known in the state of the art. Here, a demand exists to allow as good as possible to adapt the sports shoe—especially if used as sport shoe—to individual needs; this applies especially with respect to the spring and damping behaviour of the shoe.

Furthermore, the shoe should have during its use as much as possible constant and unchanging properties over the time.

A further aspect which becomes increasing important is the aspect of recycling. Here it is desired to design a generic shoe so that it can be depolluted correctly sorted.

SUMMARY OF THE INVENTION

It is the object of the invention to further develop a shoe of the above mentioned kind so that it can be adapted to individual demands in an easy manner and thus cost-effective. Furthermore, the waste disposal of the shoe should be possible in an easy manner.

The solution of this object according to the invention is characterized in that the sole comprises:

- a first sole part which comprises a ground plate, wherein a plurality of first damping elements which extend in a direction of loading are integrally shaped at the ground plate, wherein the first damping elements are formed as hollow bodies and comprise a hollow-cylindrical section in its upper end region;
- a second sole part which comprises a cover plate, wherein a plurality of second damping elements which extend in the direction of loading are integrally shaped at the cover plate, wherein the second damping elements are formed as hollow bodies and comprise a hollow-cylindrical section in its lower end region;
- a connection part which comprises a plurality of plug-in connections which are connected with another, wherein each plug-in connection comprise a first plug connector which extends downwards in the direction of loading and a second plug connector which extends upwards in the direction of loading, wherein the first plug connection is designed for frictionally dipping or engaging into the hollow-cylindrical section of the first damping element and wherein the second plug connection is designed for dipping or frictionally engaging into the hollow-cylindrical section of the second damping element.

The first plug connector and the inner diameter of the hollow-cylindrical section of the first damping element are preferably tolerated to another in such a manner that in the mounted state the first plug connector and the hollow-cylindrical section are arranged to another with press fit; corresponding the second plug connector and the inner diameter of the hollow-cylindrical section of the second damping element are preferably tolerated to another in such a manner that in the mounted state the second plug connector and the hollow-cylindrical section are arranged to another with press fit.

The first sole part can be surrounded by an edge which extends laterally upwards. By doing so the first sole part gets a shell-shaped structure.

The second sole part can have such an extension that it covers the rear sole region and leaves the front sole region uncovered. The connection part can thereby comprise plug-in connections only in that region which is covered by the second sole part. Furthermore, it can thereby be provided that the connection part comprises at least one flat footrest in that region which is not covered by the second sole part.

The first damping elements consist preferably of two partial hollow bodies which are connected with another by a connection section which extends substantially perpendicular to the direction of loading, wherein one of the partial hollow bodies is formed by the hollow-cylindrical section in the upper region of the damping element. In this case it is preferably provided that the outer dimension of the upper partial hollow body is smaller than the outer dimension of the bottom partial hollow body.

Analogue, the second damping elements can consist of two partial hollow bodies which are connected with another by a connection section which extends substantially perpendicular to the direction of loading, wherein one of the partial hollow bodies is formed by the hollow-cylindrical section in the bottom region of the damping element. Hereby, it can be provided that the outer dimension of the bottom partial hollow body is smaller than the outer dimension of the upper partial hollow body.

The plug-in connections of the connection part are preferably connected with another by a plurality of bar-shaped or rod-shaped connection rods. Especially, hereby two adjacent plug-in connections of the connection part are connected with each one connection rod.

The first sole part including all damping elements, that the second sole part including all damping elements and that the connection part including all plug-in connections are thereby preferably each designed as one-piece formed parts. The material is mostly plastic.

The shoe upper part is thereby preferably connected with the first sole part. This delivers improved kinematics at springing of the shoe due to the weight force of the wearer of the shoe.

According to a preferred embodiment of the invention the shoe upper part can be connected with the sole by means of a form-fit connection.

According to another embodiment of the invention the bootleg of the shoe, i. e. the shoe upper, and its sole are sewed with another.

Meanwhile, an essential design feature of the proposed solution is the construction of the sole and namely its damping layer which consists at least in the heel region, i. e. in the rear sole region, of two specific layers of damping element as described in WO 03/092423 A1 and to which explicitly reference is made. Thereby, two layers which are arranged on top of each other of said damping elements are connected with another by means of a connection part with lattice-shape structure via a plug-in connection. The cling together of the single parts of the sole occurs preferably exclusive by friction lock connection; an adhesive is preferably not used for that.

The bottom damping element is designed like a cage, i.e. is has preferably a shell-shaped design. The upper damping element is preferably wedged-shaped and lies on the bottom damping element. Both damping elements, thus the upper and the lower layer, are connected with another by the connection part with lattice-shaped structure by means of a plurality of axially aligned pins (first and second plug connectors) which are arranged on opposite sides.

Thereby, the connection part, i.e. the lattice layer, extends mostly along the whole region of the intermediate sole, wherein the upwards directed pins (directed to the foot of the wearer) are present only in the region of the heel wedge in the rear (and central) sole region. In the front sole region (forefoot region) the connection part closes the piston-cylinder-shaped structure of the second damping element to the ground which takes place preferably for example by a saucer-shaped enlargement of the lattice basis above each of the below first damping elements. Thereby, the resting area for the foot and for an additional provided insole respectively is increased and thus the distribution of pressure is improved.

The damping properties of the sole structure can for example be adjusted by different materials and hardness respectively of the single components. A plastic material with a range of hardness between 60 and 95 Shore A is preferred.

At first, it is the advantage of the proposed sole structure that the upper, second sole part is exchangeable so that the possibility is given to adapt said part individually.

Furthermore, it is beneficial that the sole parts which are used have a very good durableness and thus a small tendency to a permanent deformation.

Furthermore it is very beneficial that no gluing of components is necessary.

Finally, it is beneficial with regard to recycling that a (at least partial) correctly sorted separation of the single components is possible.

The use of a shoe upper part is possible with and without Strobel sole.

At a shoe upper part with Strobel sole a plugged connection between bootleg (shoe upper) and sole is provided, i. e. the sole is neither glued nor sewed to the bootleg and can be separated from the bootleg at any time. The basis for that is the above mentioned principle of the first and second sole part which are connected with another by the connection part via plug-in connection.

The first sole part with the first damping elements consists thereby preferably of the running surface and an integrated layer of the mentioned first damping elements which layer extends partially or completely along the sole.

The bootleg (i. e. the shoe upper) comprises thereby preferably recesses (holes) in the region of the inner sole which correspond with respect to the distribution and position to the plug connectors (pins) of the plug-in connection of the connection part. The connection part is inserted from the upper side into the bootleg and positioned in the same so that the plug connectors (pins) correspond with the recesses. The respective layer of the damping elements is connected, i. e. pressed in, through the recesses with the plug connectors from the bottom side (below the bootleg). The bootleg it then clamped between the connection part and the first sole part. The second sole part the then inserted into the bootleg from the upper side and plugged on the connection part.

The connection part can also be provided as a substitute for a Strobel sole. This embodiment is similar to that one as explained above, wherein the difference is given that the bootleg has no Strobel sole with recesses (holes) but the Strobel sole is substituted by the connection part (lattice). In this case, the connection part with the respective plug connectors has an additional basis (preferably made of a softer plastic material with a hardness between 65 and 90 Shore A, of leather, of synthetic leather or of textile material) which fills the open spacing of the lattice and forms the underlay for sewing of the bootleg.

This "lattice Strobel sole" is sewed to the bootleg which is open at the bottom side. The first and the second damping element are plugged on form the bottom side and from the inner side respectively.

Generally, at the bottom side of the first damping element and namely at the bottom side of its bottom plate an outer sole can be arranged.

In the drawing an embodiment of the invention is shown.

DETAILED DESCRIPTION OF THE INVENTION

Figure 1:
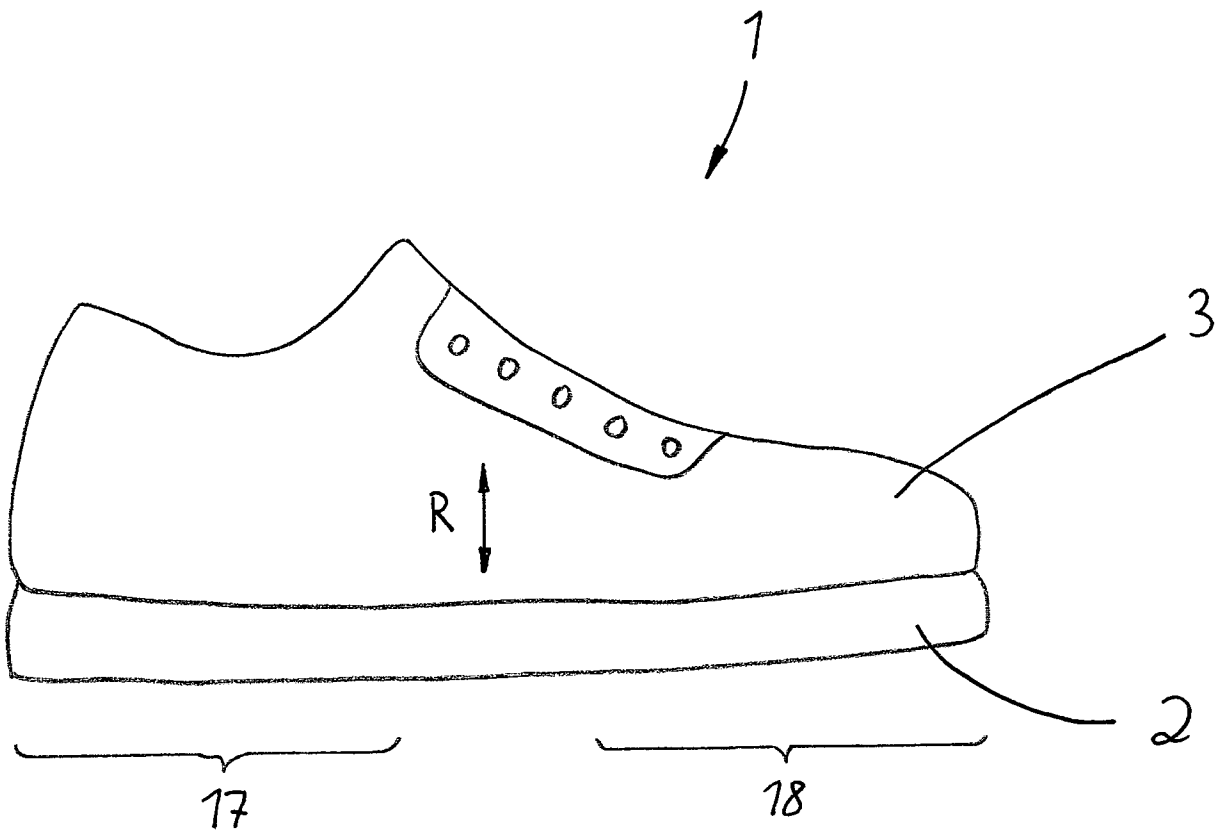
FIG. 1 shows in the side view a sports shoe.

In FIG. 1 a shoe 1 is shown which is a sports shoe and which comprises a shoe upper part 3 and a sole 2. The shoe 1 stands during intended use on the ground and is charged by the foot of the wearer. Thereby, a direction of loading R results which corresponds to the vertical direction. In FIG. 1 a rear sole region 17 and a front sole region 18 is denoted which each extend about one third of the total length of the shoe 1; in between a central sole region is arranged which is not specifically denoted.

Figure 2:
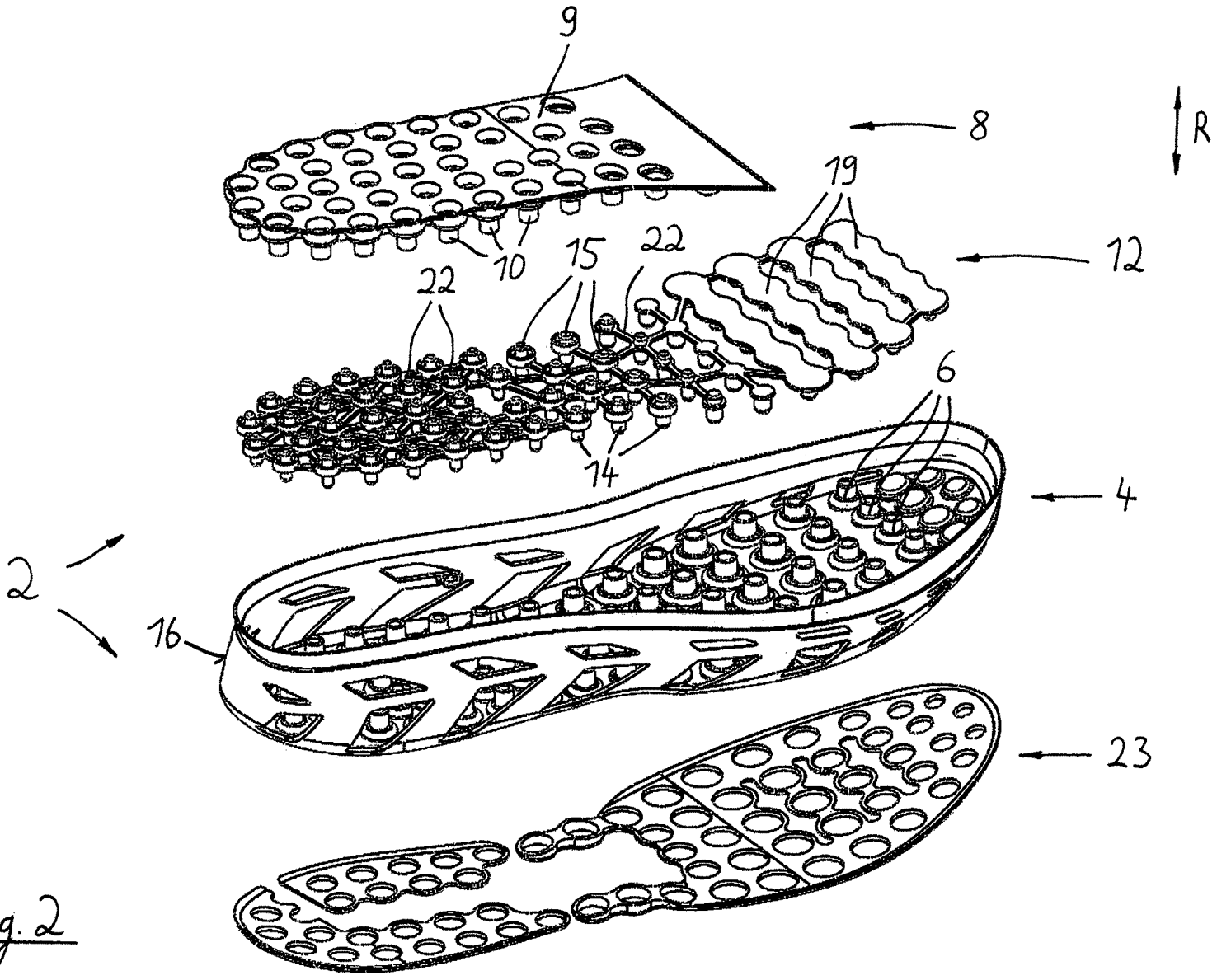
FIG. 2 shows in an exploding view the sole of the sports shoe according to FIG. 1
Figure 3:
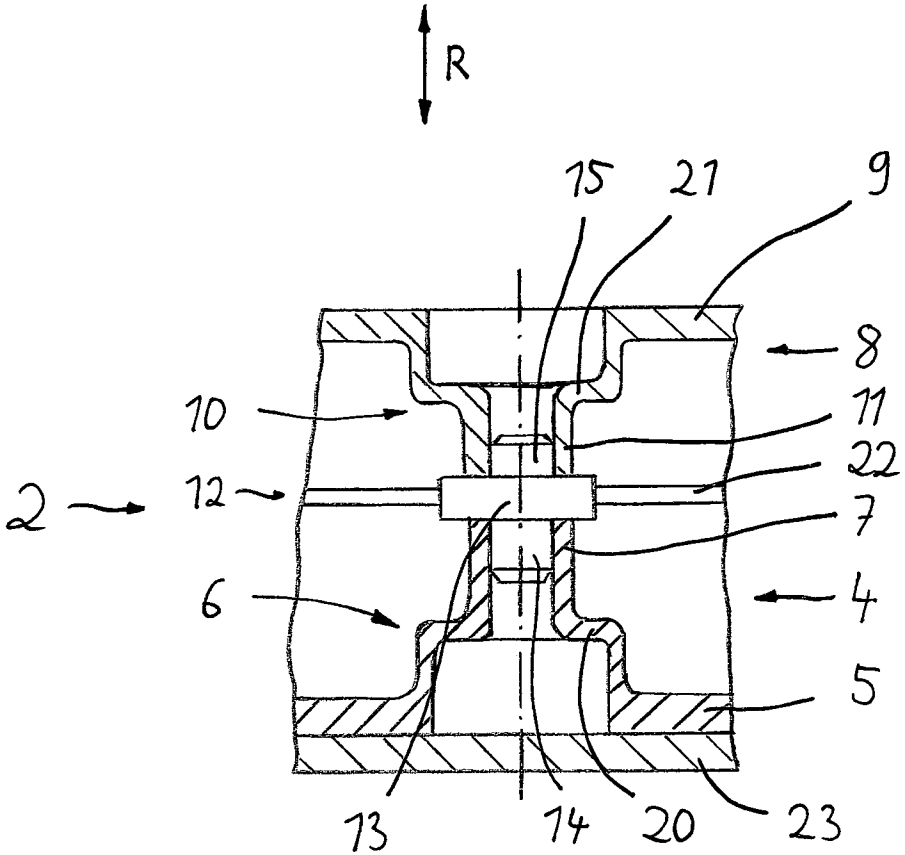
FIG. 3 shows a part of the side view in sectional view.

From FIGS. 2 and 3 the design of the sole 2 according to the invention can be seen in detail:

The sole has a first, bottom sole part 4 as well as a second, upper sole part 8. Both sole parts 4, 8 are connected with another by a connection part 12, namely as a plug-in connection and without the use of an adhesive. As can be seen in FIG. 2 the first sole part 4 has an edge 16 which runs in circumferential direction so that this part is shell-shaped.

At the bottom side of the first sole part 4 an outer sole 23 is arranged.

The first sole part 4 as well as the second sole part 8 comprise respective first damping elements 6 and second damping elements 10 respectively. The first damping elements 6 of the first sole part 4 extend from a ground plate 5 of the first sole part 4 upwards while the second damping elements 10 of the second sole part 8 extend from a cover plate 9 downwards.

The first damping elements 6 as well as the second damping elements 10 are designed as a kind of piston-cylinder damping system. Accordingly it is provided that a hollow section of the damping element with smaller outer dimensions ("piston") enters into a region being designed as hollow body with bigger outer dimensions ("cylinder") and thus develops a damping effect.

With respect to the design of those damping elements reference is made to WO 03/092423 A1 explicitly.

Insofar it should be mentioned that the first damping element 6 as well as the second damping element 10 are designed in the kind of a piston-cylinder unit, wherein a connection section 20 and 21 respectively creates the connection between the "piston" and the "cylinder".

Accordingly the first damping element 6 comprises in its upper region a hollow cylindrical section 7 while the second damping element 10 comprises in its lower region a hollow cylindrical section 11.

The lower first damping element 6 is connected with the upper second damping element 10 via a plug-in connection which is realized by the connection part 12. For this, the connection part 12 comprises a plurality of plug-in connections 13 which comprise first plug connectors 14 and second plug connectors 15 which align in the direction of loading R.

Though the second sole element 8 comprises an extension which covers substantially only the rear sole region 17 and as the case may be also the central sole region; however, the front sole region remains free from the second sole element.

It can be seen from FIG. 2 that insofar the second sole part 8 is designed wedge-shaped and covers not completely the connection part 12 which lies below the same.

So that however for the resting of the foot a well pressure distribution is ensured the connection part 12 has therefore in its region which is arranged in the front sole region 18 an enlarged saucer-shaped footrest 19.

The connection part 12 consists of single plug-in connections 13 with respective lower first plug connectors 14 and upper second plug connectors 15, wherein the single plug-in connections 13 are connected with another via connection rods 22. So a lattice-shaped structure results for the connection part 12 which can be assembled as a whole.

So the proposed concept is basing on two layers of piston-cylinder-like damping elements which are arranged on top of each other, i. e. in series, wherein the connection of those damping elements which are arranged on top of each other is effected by the connection part 12.

Here, only a connection via friction engagement and without adhesive is provided. Rather a sticking together of the first and the second sole part occurs by means of the connection part.

If the shoe upper part is directly arranged at the first sole part it is beneficial that springing movements of the shoe causes a reduced relative movement between shoe upper part and foot.

Generally, the connection of the shoe upper part 3 with the sole 2 can take place in different ways:

The shoe upper part 3 can be designed as closed (sock-like) structure which runs around the sole of the foot of the wearer, wherein for example the lower ending is realized by a Strobel sole which is sewed with the shoe upper part. In the Strobel sole openings (cuttings) can be machined which correspond to the position of the plug connectors (i.e. the hole pattern) of the connection part 12. At the assembly of the sole 2 then the so prepared shoe upper part is placed between the single sole parts in such a manner that the Strobel sole and thus the shoe upper part 3 is form-fitted connected with the sole 2.

It can also be provided that at the injection moulding process of one of the sole parts a textile material section is placed in the injection moulding tool, wherein said material section forms the Strobel sole and a part of the shoe upper part 3 respectively. So, then a firm connection which is produced by the injection moulding process exists between one of the sole parts and the textile material section and thus a connection between sole 2 and shoe upper part 3 after the assembly of the sole 2. The mentioned sole part can thereby be especially the connection part 12 or the second sole part 8.

It can also be provided at the injection of the sole part in the mentioned manner that the textile material is provided before with a respective perforation according to the hole pattern of the pins and is so inserted into the injection moulding tool.

Furthermore, as a variation of this concept it can be provided that the mentioned textile material section which forms the Strobel sole functions quasi as carrier material which is inserted into the injection moulding tool and on which then only the lattice structure is applied by the injection moulding process which is required for the production of the described plug-in connection. Therefore, especially the second sole part 8 can be taken in consideration.

If by the described way the second sole part 8 is provided with the textile material section it can beneficially be done without the use of an inserted sole as the case may be because this function is then realized by the Strobel sole which is produced in that manner. The part which is produced in such a manner is thus used as Strobel sole and comprises the plug-in connections for the described sole.

Beneficially, a very flexible and light composite material results which can be easily sewed.

Beneficially, then it can also be done without a circumferential edge 16 at the first sole part 4.

Thereby, it can also be provided that lacing bandages are a part of the textile material section which is inserted into the injection moulding tool.

With a respective design it can be reached beneficially that again a flexible and light construction is created which can be produced in an easy manner. The basis of the plastic lattice of the sole is here clearly defined, properly designed and well sealed. Furthermore, reinforcements (for example heel caps) can be integrated in an easy manner.

It can also be provided that the above described variations are used in combination insofar as they are each only used in a defined region of the sole (that is for example in the forefoot region, the midfoot region or the heel region). For example the lattice which is required for the plug-in connection is injected only in the forefoot region directly at the Strobel sole while this is not the case in the joint (i. e. midfoot) region; thus the connection of the shoe upper with the sole would take place here only as plug connection (by means of the mentioned hole pattern in the Strobel sole).

It is the benefit of this variation that no plastic areas are present in the shoe and no damping movement takes place in the shoe. Furthermore, the assembly of the shoe and the sole respectively is very easy.

As a further variation of the described concept it can be provided that it is namely done substantially without an edge 16 at or in the first sole part 4 but that however edge regions in the kind of the edge 16 are provided (only) in the region of the tip of the sole and in the region of the heel of the sole.

Preferably the single parts of the sole are made of polyolefin elastomers (e. g. TPE-S, TPU or PA).

Also, as the shoe upper part a knitted material can be provided.

LIST OF REFERENCES

1 Shoe
2 Sole
3 Shoe upper part
4 First sole part
5 Ground plate
6 First damping element
7 Hollow-cylindrical section
8 Second sole part
9 Cover plate
10 Second damping element
11 Hollow-cylindrical section
12 Connection part
13 Plug-in connection
14 First plug connector

15 Second plug connector
16 Edge
17 Rear sole region
18 Front sole region
19 Footrest
20 Connection section
21 Connection section
22 Connection rod
23 Outer sole
R Direction of loading

The invention claimed is:

1. A shoe, which comprises a sole and a shoe upper part, wherein the sole is connected with the shoe upper part, wherein the sole comprises:

a first sole part which comprises a ground plate, wherein a plurality of first damping elements which extend in a direction of loading are integrally shaped at the ground plate, the direction of loading being perpendicular to a ground when the shoe is flat on the ground, wherein the first damping elements are respectively formed as hollow bodies and comprise a hollow-cylindrical section in an upper end region of the respective first damping element;

a second sole part which comprises a cover plate, wherein a plurality of second damping elements which extend in the direction of loading are integrally shaped at the cover plate, wherein the second damping elements are respectively formed as hollow bodies and comprise a hollow-cylindrical section in a lower end region of the respective second damping element;

a connection part which comprises a plurality of plug-in connections which are directly connected with one another such that the connection part including all plug-in connections is a one-piece formed part, wherein each plug-in connection comprises a first plug connector which extends downwards in the direction of loading and a second plug connector which extends upwards in the direction of loading, wherein the first plug connector is designed for frictionally engaging into the hollow-cylindrical section of the first damping element and wherein the second plug connector is designed for frictionally engaging into the hollow-cylindrical section of the second damping element, wherein, in a relaxed state of the shoe, a lowermost extent of each first plug connector is vertically above and spaced away from a lowermost extent of the ground plate.

2. The shoe according to claim 1, wherein each hollow-cylindrical section of the first damping elements of the plurality of first damping elements has an inner diameter, and each hollow-cylindrical section of the second damping elements of the plurality of second damping elements has an inner diameter, wherein the first plug connector and the second plug connector are each dimensioned so as to fit in each respective inner diameter of each respective hollow-cylindrical section in a press fit manner, wherein the first sole part including all the first damping elements is a one-piece formed part, and wherein the second sole part including all the second damping elements is a one-piece formed part.

3. The shoe according to claim 1, wherein the first sole part is surrounded by an edge which extends laterally upwards when the shoe is flat on the ground.

4. The shoe according to claim 1, wherein the second sole part has an extension so that the second sole part covers a rear region of the sole and leaves a front region of the sole uncovered by the second sole part.

5. The shoe according to claim 4, wherein the connection part comprises the plug-in connections only in the rear region which is covered by the second sole part.

6. The shoe according to claim 5, wherein the connection part comprises at least one flat footrest in the front region which is not covered by the second sole part.

7. The shoe according to claim 1, wherein each of the first damping elements consists of two partial hollow bodies, including an upper partial hollow body and a bottom partial hollow body, which are connected together by a connection section which extends laterally to the direction of loading, wherein the upper partial hollow body is formed by the hollow-cylindrical section in the upper region end of the respective first damping element.

8. The shoe according to claim 7, wherein the outer dimension of the upper partial hollow body is smaller than the outer dimension of the bottom partial hollow body.

9. The shoe according to claim 1, wherein each of the second damping elements consists of two partial hollow bodies, including an upper partial hollow body and a bottom partial hollow body, which are connected with another by a connection section which extends laterally to the direction of loading, wherein the bottom partial hollow body is formed by the hollow-cylindrical section in the lower end region of the respective second damping element.

10. The shoe according to claim 9, wherein the outer dimension of the bottom partial hollow body is smaller than the outer dimension of the upper partial hollow body.

11. The shoe according to claim 1, wherein the plug-in connections of the connection part are connected with another by a plurality of connection rods.

12. The shoe according to claim 11, wherein two adjacent ones of the plurality of plug-in connections of the connection part are connected to one another with one of the connection rods.

13. The shoe according to claim 1, wherein the shoe upper part is connected with the first sole part.

14. The shoe according to claim 1, wherein the shoe upper part is connected with the sole by a form-fit connection.

* * * * *